US005788535A

United States Patent [19]

Stinsky et al.

[11] Patent Number: 5,788,535

[45] Date of Patent: Aug. 4, 1998

[54] ADAPTOR ASSEMBLY

[75] Inventors: Vadim R. Stinsky, Ithaca; David E. Dunham, Pine City, both of N.Y.

[73] Assignee: Augat/LRC Electronics, Inc., Horseheads, N.Y.

[21] Appl. No.: 712,334

[22] Filed: Sep. 11, 1996

[51] Int. Cl.[6] ..... H01R 17/18

[52] U.S. Cl. ..... 439/578; 333/260

[58] Field of Search ..... 439/578, 583, 439/584, 585; 333/260, 243, 244, 245

[56] References Cited

U.S. PATENT DOCUMENTS

| | | | |
|---|---|---|---|
| 2,439,841 | 4/1948 | Carsten et al. | 439/578 |
| 3,671,926 | 6/1972 | Nepovim | 439/584 |
| 4,291,936 | 9/1981 | Oldfield et al. | 39/177 R |
| 4,374,606 | 2/1983 | Lathrop | 339/177 R |
| 4,397,515 | 8/1983 | Russell | 339/177 R |
| 4,556,265 | 12/1985 | Cunningham | 339/17 LC |
| 4,676,577 | 6/1987 | Szegda | 439/584 |
| 4,687,279 | 8/1987 | Holland et al. | 439/578 |
| 4,700,159 | 10/1987 | Jones, III | 333/244 |
| 4,707,039 | 11/1987 | Whipple | 439/75 |
| 4,766,669 | 8/1988 | Schwartzman | 29/828 |
| 4,836,791 | 6/1989 | Grabbe et al. | 439/79 |
| 4,854,893 | 8/1989 | Morris | 439/578 |
| 4,861,271 | 8/1989 | Bogar et al. | 439/63 |
| 4,917,630 | 4/1990 | Hubbard | 439/578 |
| 4,963,104 | 10/1990 | Dickie | 439/460 |
| 4,990,106 | 2/1991 | Szegda | 439/585 |
| 5,041,020 | 8/1991 | Michael | 439/578 |
| 5,055,068 | 10/1991 | Machura et al. | 439/581 |
| 5,060,373 | 10/1991 | Machura et al. | 29/858 |
| 5,066,249 | 11/1991 | Doye et al. | 439/585 |
| 5,073,129 | 12/1991 | Szegda | 439/585 |
| 5,100,344 | 3/1992 | Troung | 439/578 |
| 5,125,470 | 6/1992 | Henry et al. | 439/63 |
| 5,167,532 | 12/1992 | Bruno et al. | 439/578 |
| 5,195,906 | 3/1993 | Szegda | 439/394 |
| 5,217,391 | 6/1993 | Fisher, Jr. | 439/578 |
| 5,278,525 | 1/1994 | Palinkas | 333/175 |
| 5,283,853 | 2/1994 | Szegda | 385/139 |
| 5,315,684 | 5/1994 | Szegda | 385/139 |
| 5,327,111 | 7/1994 | Gipprich | 333/260 |
| 5,329,262 | 7/1994 | Fisher, Jr. | 333/33 |
| 5,339,058 | 8/1994 | Lique | 333/327 |
| 5,340,325 | 8/1994 | Pai | 439/188 |
| 5,342,218 | 8/1994 | McMills et al. | 439/578 |
| 5,371,819 | 12/1994 | Szegda | 385/75 |
| 5,371,821 | 12/1994 | Szegda | 385/87 |
| 5,371,827 | 12/1994 | Szegda | 385/136 |
| 5,393,244 | 2/1995 | Szegda | 439/394 |
| 5,431,583 | 7/1995 | Szegda | 439/589 |
| 5,437,831 | 8/1995 | Roose | 264/322 |
| 5,444,810 | 8/1995 | Szegda | 385/139 |
| 5,456,614 | 10/1995 | Szegda | 439/321 |
| 5,470,257 | 11/1995 | Szegda | 439/578 |
| 5,651,698 | 7/1997 | Locati et al. | 439/578 |
| B1 5,073,129 | 12/1991 | Szegda | 439/585 |

OTHER PUBLICATIONS

*Trilogy Communications, Inc.* "MC2 Coaxile Cable Materials and Construction", 1 data sheet (undated).

*Primary Examiner*—P. Austin Bradley
*Assistant Examiner*—Tho D. Ta
*Attorney, Agent, or Firm*—Weingarten, Schurgin, Gagnebin & Hayes LLP

[57] ABSTRACT

An adaptor assembly which functions as an extender for coaxial cable connectors. The adaptor assembly includes a support element which provides for support and isolation of a terminal within an assembly housing and minimizes electrical signal degradation by providing only a minimal amount of dielectric material to support the terminal within the housing. Additionally, a metal bushing is provided as part of an auto-seizing assembly and prevents lock-up of the adaptor assembly during installation of the assembly onto a coaxial cable connector.

13 Claims, 2 Drawing Sheets

ADAPTOR ASSEMBLY

FIELD OF THE INVENTION

The present invention relates generally to coaxial cable connectors and more particularly to extenders for coaxial cable connectors.

BACKGROUND OF THE INVENTION

In a coaxial cable connector extender the terminal of the extender must be isolated from the extender housing. A variety of dielectric materials have been used to provide this function. While air is the best dielectric material as far as electrical performance is concerned since in an air dielectric the velocity of propagation of the electromagnetic wave is minimal and the characteristic impedance is relatively minimal minimizing line losses. An air dielectric however cannot provide the mechanical support needed between the terminal and the housing. Many plastic dielectric materials can be used which provide a compromise between electrical performance and mechanical performance. Plastic dielectric materials are usually shaped as cylinders and placed inside the housing, surrounding a portion of the terminal. Electrical performance of the connector extender is negatively affected by the amount of plastic dielectric material used. In some instances a mechanical element is required to maintain the dielectric material in place within the housing of the connector extender.

An additional problem associated with prior art coaxial cable extenders is known as "lock-up". Lock-up occurs when the connector pin from a coaxial connector is inserted into the metal terminal of the adaptor assembly. As the adaptor assembly is installed onto the connector, a plastic collar is driven axially into the housing, with the tapered bore of the collar being forced against the end of the terminal, thereby compressing the terminal about the connector pin. When the pressure supplied by the closing collar being driven into the housing in order to compress the end of the terminal over the connector pin exceeds the yield strength of the plastic collar, the metal terminal becomes embedded in the tapered section of the plastic collar, thereby locking up the adaptor assembly. Once lock-up has occurred, it becomes difficult to separate the collar from the terminal.

SUMMARY OF THE INVENTION

An adaptor assembly functions as a coaxial cable connector extender for coaxial cable connectors. The adaptor assembly comprises a housing including a terminal configured to receive at one end thereof a connector pin from a cooperating coaxial connector. The adaptor assembly further includes at least one terminal support element for supporting the terminal within the housing while maintaining the terminal isolated mechanically and electrically from the housing. The adaptor assembly also contains an auto-seizing assembly comprising a collar, a spacer and a bushing which are configured to compress an end of the terminal onto the connector pin of the cooperating coaxial connector when the adaptor assembly is installed. The bushing is configured to prevent lock-up of the adaptor assembly. The adaptor assembly provides a high performance, low cost extension of a coaxial cable connector.

BRIEF DESCRIPTION OF THE DRAWINGS

The invention will be more fully understood from the following detailed description taken in conjunction with the accompanying drawings in which.

DETAILED DESCRIPTION

Figure 1:
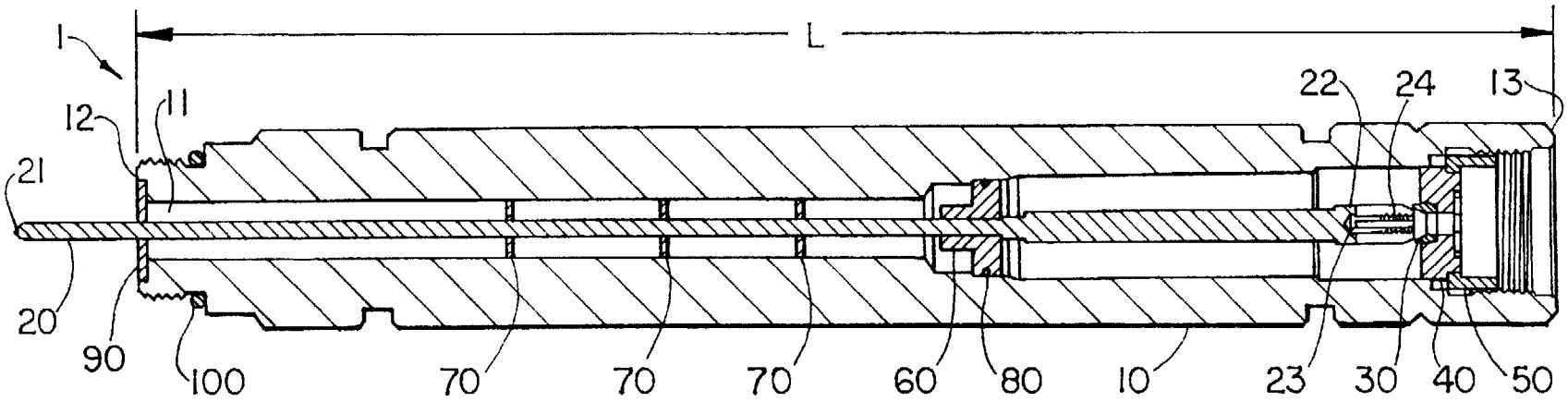
FIG. 1 is a cross-sectional diagram of the adaptor assembly of the present invention.
Figure 3:
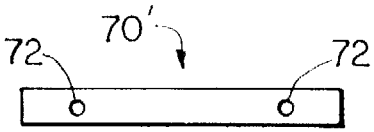
FIG. 3 is a diagram of a support element.

FIG. 1 shows an adaptor assembly 1 according to the present invention. The adaptor assembly functions as a coaxial cable connector extender when installed on an end of a coaxial cable connector or another extender. The adaptor assembly 1 is provided in a plurality of lengths producing extensions of three inches, six inches, nine inches and twelve inches, although other lengths could be implemented.

The adaptor assembly 1 includes a housing 10, which is made from a conductive material such as aluminum. The housing 10 includes a central bore 11 disposed therethrough. An electrically conductive terminal 20 is disposed within the central bore 11 of housing 10. A first end 21 of the terminal 20 extends beyond a first end 12 of the housing 10, and serves as a male or pin terminal. A second end 22 of the terminal 20 is located within the second end 13 of the housing 10 and includes slots 23 defining fingers to make the end 22 compressible. The second end 22 serves as a female terminal and includes a plurality of serrations 24 in order to provide for a secure electrical and mechanical connection to a conductor inserted therein.

An auto-seizing assembly comprising a bushing 30, collar 40 and spacer 50 is disposed along a common longitudinal axis within the second end 13 of the housing 10. Bushing 30, collar 40 and spacer 50 are open on each of two ends and have a central bore disposed therethrough. The first end of spacer 50 abuts the second end of collar 40. A first end of collar 40 is configured to receive bushing 30 therein.

Bushing 30 is of tapered configuration matching the tapered end of second end 22 and operates to compress the second end 22 of terminal 20 when a mating connector is installed. Bushing 30 is comprised of metal and thus prevents the occurrence of lockup of the assembly, as will be described below.

Figure 2:
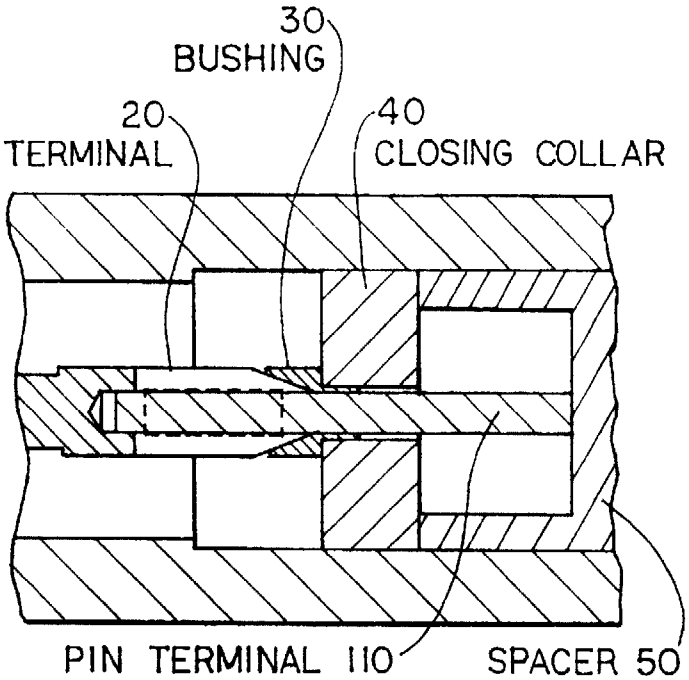
FIG. 2 is a cross sectional diagram of a portion of the adaptor assembly of FIG. 1.

Referring now to FIGS. 1 and 2, during installation of the adaptor assembly 1 onto a connector or another extender, the pin 110 from the cooperating cable connector is inserted into the second end 13 of housing 10. The connector pin 110 is received within the second end 22 of terminal 20. As the adaptor assembly 1 is installed on the connector, spacer 50 is driven axially toward terminal 20 resulting in collar 40 also being driven deeper into housing 10. Collar 40 is configured to include a metal bushing 30. Metal bushing 30 includes a tapered bore for engaging the end of terminal 20. The tapered bore at the first end of bushing 30 is forced against the tapered portion of the second end 22 of terminal 20, resulting in compression of the second end of terminal 20 about the inserted connector pin 110. A flat surface of bushing 30 is abutting a flat surface of collar 40, thus the bushing 30 does not become embedded in collar 40 and, since the terminal 20 and the bushing 30 are comprised of metal the terminal 20 does not become embedded in the bushing 30, thus lockup of the adaptor assembly 1 is prevented. A secure mechanical and electrical connection is provided by the adaptor assembly 1 to the connector pin 110 of the coaxial cable connector.

Adaptor assembly 1 further includes an entry support 60 disposed along a common longitudinal axis within housing 10. Entry support 60 has a central bore disposed therethrough sized to receive a portion of terminal 20. Entry support 60 also includes an annular recess for supporting a first o-ring 80.

An end insulator 90 of adaptor assembly 1 is disposed along a common longitudinal axis within housing 10 adjacent the first end 12 thereof. End insulator 90 includes a central bore for supporting terminal 20.

At least one support element 70 is disposed along a common longitudinal axis within the housing 10. The number of support elements required are dependent upon the length L of the adaptor assembly. While support element 70 is shown in this embodiment as a disk having a central bore, it should be appreciated that other embodiments may also be utilized. The support element 70 is comprised of a plastic material and provides mechanical support for physically isolating the terminal 20 from the housing 10 as well as electrically insulating the terminal 20 from the housing 10. Electrical performance of the adaptor assembly 1 is negatively affected by the amount of plastic dielectric material utilized. The support elements 70 provide for a minimal amount of plastic dielectric material, and thereby affords improved electrical performance of the adaptor assembly 1.

Figure 4A:
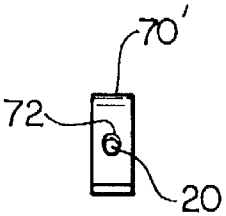
FIG. 4A is an end view of the support element of FIG. 4.
Figure 4:
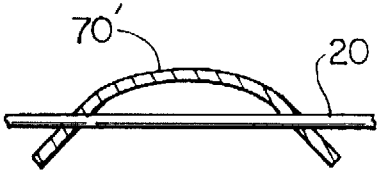
FIG. 4 is a side view of the support element of FIG. 3 installed on a terminal.
Figure 5A:
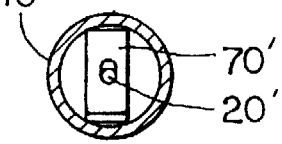
FIG. 5A is an end view of the support element of FIG. 3.
Figure 5:
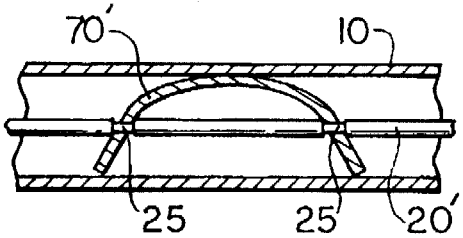
FIG. 5 is a cross-sectional side view of the support element of FIG. 3 installed in an adaptor assembly.

FIGS. 3–5A show an additional embodiment of a support element. Support element 70' is comprised of a flat strip of dielectric material including two holes 72 sized to receive a portion of the terminal therethrough. While this embodiment shows a flat rectangular strip it should be appreciated that other shapes could be implemented, as could different numbers of holes. FIGS. 4 and 4A show the support element 70' installed on a terminal 20. The strip is bowed, and a portion of terminal 20 extends through holes 72. FIGS. 5 and 5A show the support element 70' installed in an adaptor assembly 1. The support element 70' mechanically supports the terminal 20 within the housing 10, as well as providing electrical insulation of the terminal 20 from the housing 10. Additionally, the support element 70' functions as a spring to secure itself within the housing 10. The deformation of the bowed shape of the support element 70' at its apex where it abuts the housing 10 and the tension provided by the ends of the support element 70' where they contact the housing 10 maintain the support element 70' from unintended movement within the housing 10, thereby removing the need for a retaining mechanism. Further, an alaternate embodiment of the terminal 20' is provided with concentric grooves 25 that retain the ends of the support element 70' and provide additional resistance to movement.

By providing electrical and mechanical isolation of the terminal within the housing with a minimal amount of plastic and by providing mostly air insulation, the electrical performance of the adaptor assembly is thus improved. Additionally, since less material is involved, support elements of this type are lower cost.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

We claim:

1. An adaptor assembly comprising:

a housing open on each of a first end and a second end, and having a central bore disposed therethrough;

a terminal having a first end and a second end, disposed along a common longitudinal axis within said housing such that a first end of said terminal extends beyond the first end of said housing, the second end of the terminal having a central bore sized to receive a conductor therein and disposed a predetermined distance within the second end thereof;

at least one terminal support element disposed along the common longitudinal axis within the central bore of said housing and surrounding a first portion of said terminal;

an auto-seizing element comprising:

a collar open on each of a first end and a second end, disposed along the common longitudinal axis within said housing, having a central bore disposed therethrough, and configured to receive the conductor therethrough;

a spacer open on each of a first end and a second end, disposed along the common longitudinal axis within said housing, having a central bore dispose therethrough, and the first end thereof abutting the second end of said collar; and a bushing having a first end and a second end, having a central bore therethrough, disposed along the common longitudinal axis within said housing and isolated from an internal surface of said housing such that a first end thereof is adjacent the second end of said terminal and a second end thereof abuts the first end of said collar, and configured to compress the second end of said terminal about the conductor when said adaptor assembly is installed; and an entry support having a central bore disposed therethrough, disposed along the common longitudinal axis within said housing, and surrounding a second portion of said terminal.

2. The adaptor assembly of claim 1 wherein said bore of said terminal includes a plurality of serrations disposed along a section of an interior surface thereof.

3. The adaptor assembly of claim 1 wherein the second end of said terminal includes slots.

4. The adaptor assembly of claim 1 further comprising threads disposed about an external surface of said housing adjacent the first end of said housing.

5. The adaptor assembly of claim 1 further comprising threads disposed about said internal surface of said housing adjacent the second end of said housing.

6. The adaptor assembly of claim 1 wherein said housing includes a first o-ring adjacent said threads disposed about the external surface of said housing.

7. The adaptor assembly of claim 1 wherein said housing and said terminal are comprised of electrically conductive material.

8. The adaptor assembly of claim 1 wherein said bushing is comprised of metal.

9. The adaptor assembly of claim 1 wherein said entry support includes an annular recess supporting a second o-ring.

10. The adaptor assembly of claim 1 wherein said collar and said entry support are comprised of electrically non-conductive material.

11. The adaptor assembly of claim 1 wherein said terminal and said housing have a predetermined length that provides for an extension having a length selected from the group consisting of approximately three inches, approximately six inches, approximately nine inches and approximately twelve inches.

12. The adaptor assembly of claim 1 further comprising an insulator disposed along the common longitudinal axis within said housing and adjacent the first end of said housing, having a central bore disposed therethrough and surrounding a third portion of said terminal.

13. The adaptor assembly of claim 12 wherein said insulator is comprised of electrically non-conductive material.

* * * * *